US007322136B2

(12) United States Patent
Chen

(10) Patent No.: US 7,322,136 B2
(45) Date of Patent: Jan. 29, 2008

(54) ELECTRIC FIREPLACE HAVING A FIRE SIMULATING ASSEMBLY

(75) Inventor: Jianming Chen, Shanghai (CN)

(73) Assignee: Chen Yuepeng, Cixi (CN)

( * ) Notice: Subject to any disclaimer, the term of this patent is extended or adjusted under 35 U.S.C. 154(b) by 282 days.

(21) Appl. No.: 11/124,764

(22) Filed: May 9, 2005

(65) Prior Publication Data

US 2005/0252051 A1 Nov. 17, 2005

(30) Foreign Application Priority Data

May 14, 2004 (CN) ..... 2004 2 0022732 U

(51) Int. Cl.

| | |
|---|---|
| ***G09F 19/00*** | (2006.01) |
| ***G09F 13/00*** | (2006.01) |
| ***F24B 1/18*** | (2006.01) |
| ***B60Q 1/14*** | (2006.01) |
| ***F21S 4/00*** | (2006.01) |

(52) U.S. Cl. ..... 40/428; 40/441; 40/431; 392/348; 362/280; 362/217

(58) Field of Classification Search ..... 40/428; 392/348; 472/65; 362/806, 329, 334, 325, 362/280, 282, 322, 324, 284
See application file for complete search history.

(56) References Cited

U.S. PATENT DOCUMENTS

| | | | | |
|---|---|---|---|---|
| 2,194,899 | A * | 3/1940 | Hansson | 40/428 |
| 2,963,807 | A * | 12/1960 | Relph et al. | 40/428 |
| 4,800,473 | A * | 1/1989 | Tremblay | 362/217 |
| 6,302,555 | B1 * | 10/2001 | Bristow | 362/96 |
| 6,393,207 | B1 * | 5/2002 | Martin et al. | 392/348 |

FOREIGN PATENT DOCUMENTS

| | | |
|---|---|---|
| CN | 1327138 | 12/2001 |

* cited by examiner

*Primary Examiner*—Lesley D. Morris
*Assistant Examiner*—Syed A Islam
(74) *Attorney, Agent, or Firm*—Winstead PC

(57) ABSTRACT

An electric fireplace having a fire simulating assembly is provided. The fire simulating assembly includes a semitransparent light filter screen, a mirror glass wall and a dynamic light source. The dynamic light source includes fixed light source and a photic cover composed with many rotating centrifugal blades. There are many photic apertures in flame shape. The centrifugal blades rotate around a center of the light source. There are clearances between the centrifugal blades causing light to reflect through the centrifugal blades. The electric fireplace achieves a natural effect of vivid, rising and leaping simulated flame.

10 Claims, 6 Drawing Sheets

ELECTRIC FIREPLACE HAVING A FIRE SIMULATING ASSEMBLY

FIELD OF THE INVENTION

The present invention relates to an electric fireplace, in particular, relates to an electric fireplace having a fire simulating assembly.

BACKGROUND OF THE INVENTION

Heating is necessary for the human being from ancient time. People warm themselves by burning branches of trees since the invention of how to make fire. With the increasing of living standard, electric fireplace has been one of the popular heating means.

The means of electric heating in existence have two categories: the heater only supplying warm and the electric fireplace having both flame vision and warming function. The latter is an electric fireplace unit having a fire simulating assembly to simulate flame vision. The fire simulating assembly is generally divided into two categories. The first kind of the assembly is a simulating combustion medium such as coal or burning branches. Such combustion medium is usually substituted by plastic house with branch shape and color on its surface. A set of lamps are located within the plastic house in order to simulate the burning branches vision and another set of silk in blame shape hung above this medium, which waves with air blowing. We can see the flame vision through semitransparent plastic screen and mirror glass. However, such simulating flames have some disadvantages such as no transparent vision as real burning flame, no flame leaping and rising phenomena. The second kind of assembly is to install rotating glistening slices rotated by the electric motor or photic cover with all kinds of shapes. The principle of rotating glistening slice is that multi-groups glistening slices are fixed on the rotating axis, and then using the reflection of exterior lamp to obtain simulated flame. There is also a euphotic assembly in which euphotic cover rotates with the rotating axis. As described in CN 01113160, a flame simulating assembly for an electric heater was published. The principle of the application CN 01113160 is to use the interior light through abnormity aperture, and then to produce flame vision with flame model. The flames are projected on semitransparent plastic screen and mirror glass. Then, we will see the ideal simulated flame with flame rising effect. Either the simulated flames of rotating slice or any shape of flames which obtained through euphotic cover has some advantages, that is so say, increasing luminance of flame and obtaining the ideal rising and leaping simulated flame. But these assemblies use compelling model such as flame wall model. Thus producing some disadvantages such as the impression of flame is very mechanical, and, the flames are in short of hiberarchy or natural vision when producing simulated flame. Therefore, the flames produced by the above-mentioned simulating assembly have disadvantages including bad natural simulating vision and using compelling model. Furthermore, the light source can only pass through the single flame pore in the hollow cylinder of the euphotic cover. The heat eliminating under the closed cylinder is not very good that will shorten the using life of the assembly.

SUMMARY OF THE INVENTION

The present invention is to provide an improved electric fireplace with a flame simulating assembly that produces a rising, leaping and natural flame in order to solve above-mentioned problems.

The invention provides an electric fireplace with a flame simulating assembly. The flame simulating assembly comprises a semitransparent light filter screen; a mirror glass wall and a dynamic light source. The dynamic light source comprises a fixed light source and photic cover with a set of rotating centrifugal blades. There are many apertures with flame shape on the surface of the centrifugal blades. The said centrifugal blades may rotate around the center of the light source. The centrifugal blades are distributed at the periphery of the light source and not joined with each other, allowing glistening clearances between the blades. The fixed light source is reflected through centrifugal blades. The center of curvature of each centrifugal blade is not in the line of the center axis of the fixed light source whereby static bias and dynamic eccentricity are formed between the arc centers of blades and rotating center.

Further, the invention provides an electric fireplace with a flame simulating assembly in which several flicking board with flame color is set at the periphery of the fixed light source.

This invention involves an electric fireplace with a flame simulating assembly in which a dynamic light source comprising centrifugal blades designed to be eccentric to the axis of the fixed light source to achieve an effect of flickering flames. An effect of dot-shaped flicking flames can be achieved because of the eccentricity and the unequal distances between the flame-shaped apertures on the surface of centrifugal blades and the fixed light source resulting different linear velocities of the light source as the variation of the center of the curvature of the centrifugal blades in rotation. Furthermore, due to the fact that the blades do not join, an effect of flame-shaped blazing fire in the lower part can be achieved by light reflected through the clearances between the blades. The light cast through the flame-shaped apertures on the blades and reflected through the clearances between the blades form a natural, textured combination of billowing, dancing dot-shaped flames in the upper part and flake-shaped blazing fire in the lower part. In addition, the structure of unjoined centrifugal blades has an intrinsic advantage of substantial heat radiation that prolongs the life of the fireplace.

DESCRIPTION OF THE DRAWINGS

The invention will be better understood with reference to the drawings, and following description, in which.

The compositions of the invention are generally shown as: 1—fireplace, 2—simulated flame, 3—simulated charcoal, 4—light filter screen, 5—dynamic punctate light source passing through the aperture in flame shape of the centrifugal blades, 6—dynamic light source system of the centrifugal blades, 7—glass wall with a mirror surface, 8—light source for simulated charcoal, 9—light radiation for estimated log, 10—electric heater, 11—electric motor, 12—fixed light source, 13—aperture in the shape of flame, 14—connecting rod, 15—photic cover, 18—covering board, 21—dynamic flake light source passing through the aperture of the centrifugal blades, 22—clearance strap of the centrifugal blades, 41—photic aperture of flame, 151—centrifugal blades, 153—flicking board, A—axis where the light source located, B—center of curvature.

DETAILED DESCRIPTION OF THE PREFERRED EMBODIMENT(S)

The invention will be better understood with the following further description of the embodiment. It should be understood that the protection scope should not be limited by the embodiments. Any similar structure or any obvious change of the structure should be in the scope of the invention.

Figure 1:
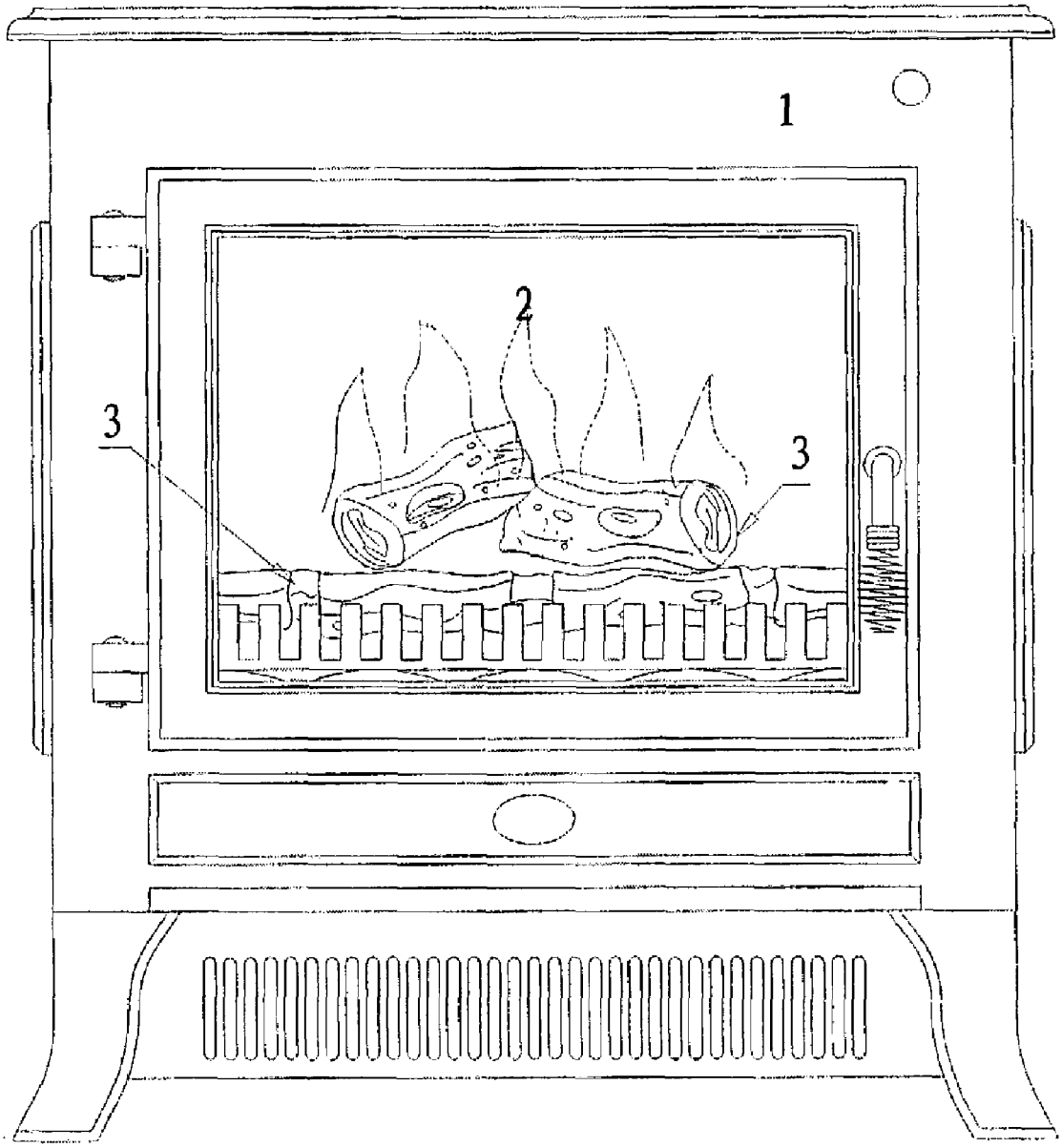
FIG. 1 is a front perspective view of a burning fire.
Figure 2:
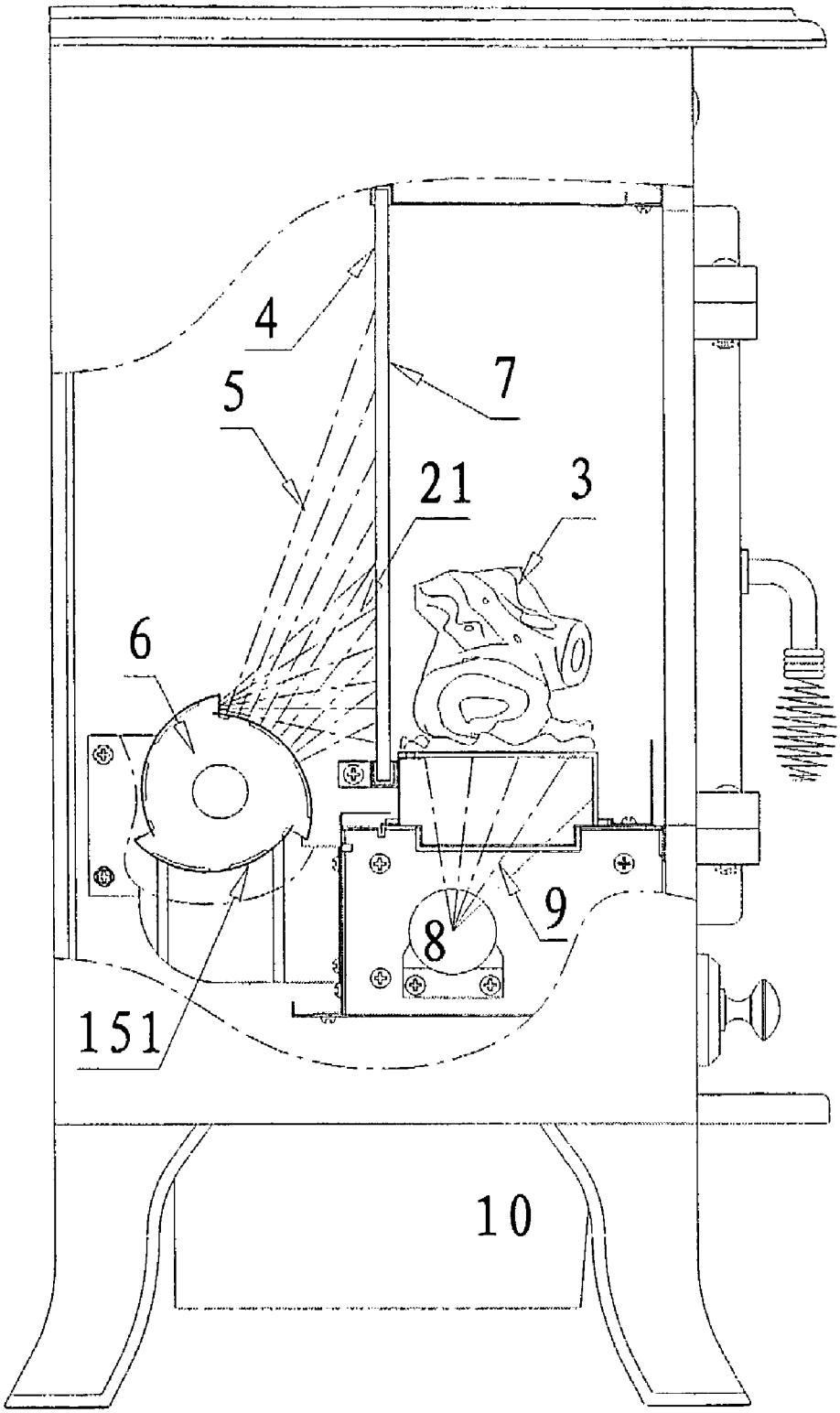
FIG. 2 is a side perspective view of a fireplace with fire simulating assembly.
Figure 3:
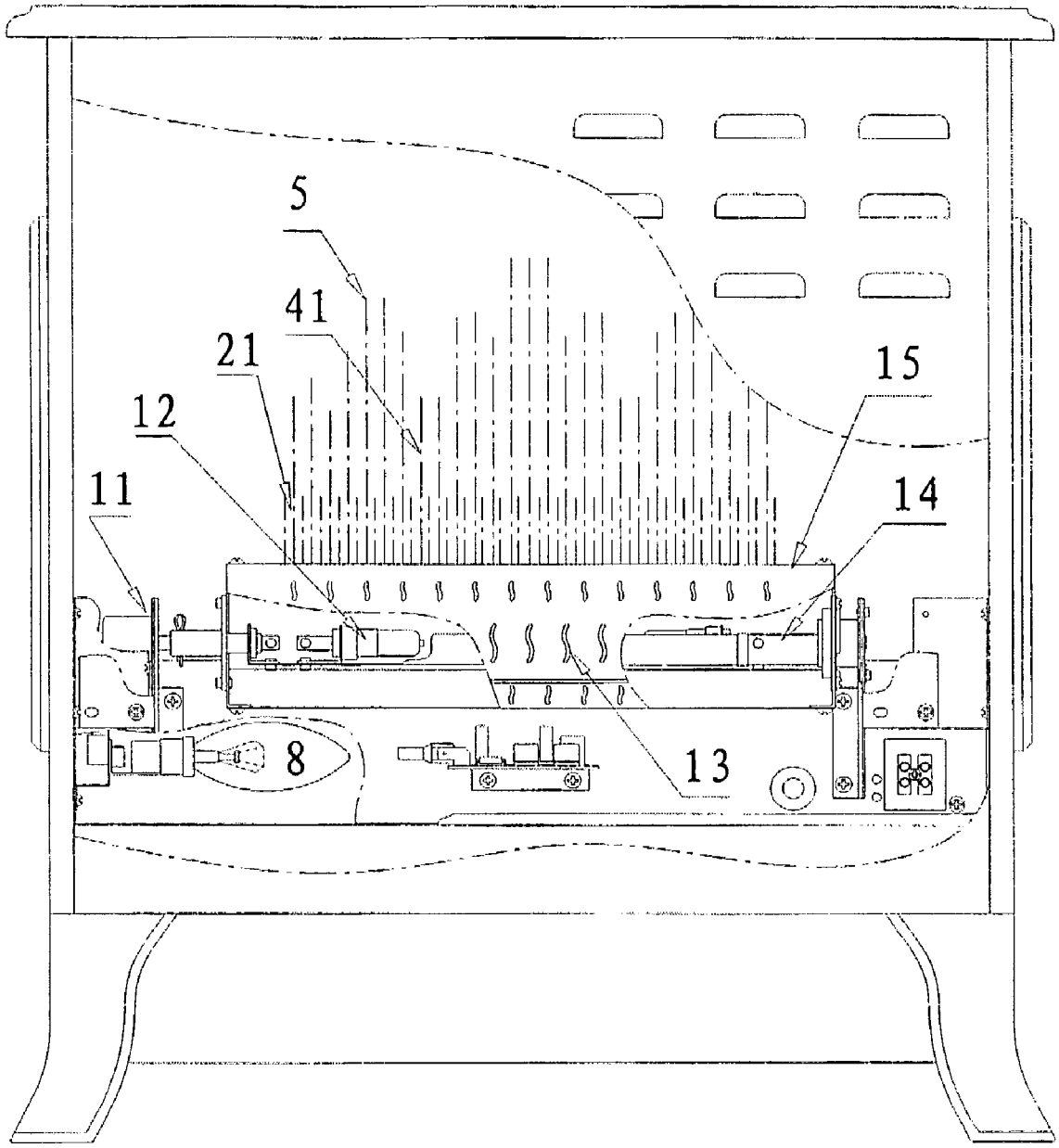
FIG. 3 is a back perspective view of a fireplace with fire simulating assembly.

Referring to FIG. 1 to FIG. 3, the invention relates to an electric fireplace with a flame simulating assembly, comprising: simulated charcoal 3, light source for simulated charcoal 8, the electric heating fitting 10 and flame simulating assembly. The flame simulating assembly includes dynamic light source 6, light filter screen 4 and the glass wall with a mirror surface 7. This dynamic light source 6 includes the fixed light source 12 and photic cover 15 which is composed of three active centrifugal blades 151. The light filter screen 4 is made of plastic or organic glass slice treated by spraying or printing in order to obtain translucency and filter effect. Furthermore, there are many apertures 41 on the surface of light filter screen 4. The glass wall with a mirror surface 7 may be brown with the light filter screen on the left side. The light filter screen 4 may integrate with the glass wall with a mirror surface 7. The simulated charcoal 3 was made of plastic branches with coat to simulate the irregular knaggy veins on the surface of simulated charcoal 3. Light source for simulated charcoal 8 is installed in the simulated charcoal 3 to form "simulated charcoal" assembly. After powered, the simulated branches charcoal will be in combustion state with rubicund veins. The light intensity of the simulated flame may be adjusted by control the switch of the light source. An electric heater 10, which selected from all types of electric heating assembly, locates under the fireplace. It will heat by turning on a switch of temperature controlling.

The fixed light source includes normal lighting bulb, lamps and lanterns, halogen light and so on. Number of the lamps may be more than one. The lamp in the lamp holder is fixed on the connecting rod 14 for locating the lamps. The connecting rod 14 is then fixed in the central of the photic cover with centrifugal blades. The shape of the centrifugal blade 151 includes flake, arc, plane or other kinds of curve. The two ends of the centrifugal blades are fixed on the two sidewalls respectively. One of the sidewalls is fixed with the rotating axis of the electric motor 11. There are many photic apertures 13 with flame shape in the surface of the active centrifugal blades 151. The apertures may be made into all kinds of shapes as required such as: triangle, S shape and so on. The flicking board 153 is placed at the periphery of the centrifugal blades 151 to make a further dynamic effect of the flame. When the photic cover 15 and the flicking board 153 are rotated by the electric motor 11, the light from the fixed light source passes through the photic apertures 13 of the rotating centrifugal blades 151 and the clearance 22 of the blades and then is flicked with the flicking board 153. Thus, the dynamic punctate flame light 5 and dynamic flake flame light 22 are sent out to the semitransparent plastic flake. After filtered by the plastic flake, the light is displayed on the glass wall with mirror surface. Then, a simulated flame which is dynamic leaping and rising is seen. The house of the electric fireplace is made of lumber or metal.

Figure 4:
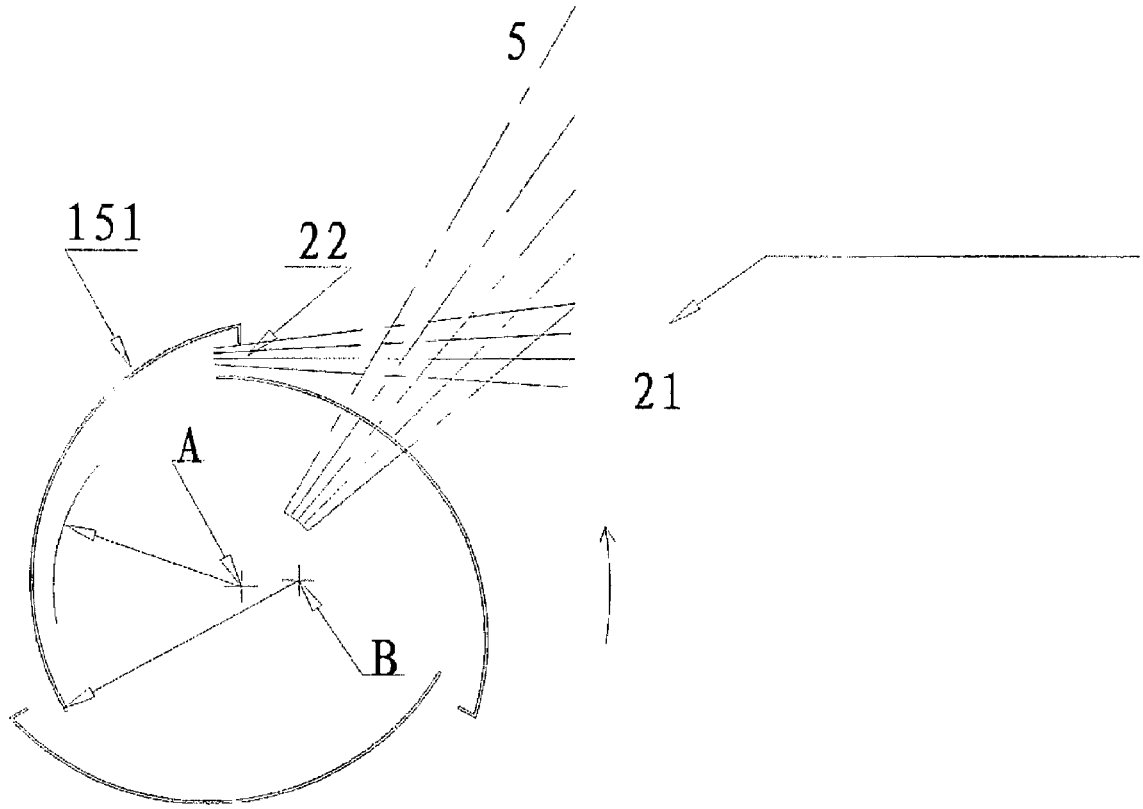
FIG. 4 is a distributing perspective view of the three centrifugal blades in one preferred embodiment of the invention.

Referring to FIG. 4, the centrifugal blades 151 are located at the periphery of the light source. They are not joined together with each other. The centrifugal blades 151 may be made of metal or other nonmetal materials. A designates the axis location of the light source 12. All light from the light source 12 is covered with the photic cover composed with the centrifugal blades. The centers of the curvatures of every centrifugal blade are not the same as the central of the axis A whereby eccentricity is formed. Thus, the centrifugal blades may both close off the light from the fixed light of the dynamic light source and glistening the dynamic flake light 21 through the disclosed clearance 22 of the blades to the glass screen of the curtain wall using the glisten theory of the optics.

Figure 5:
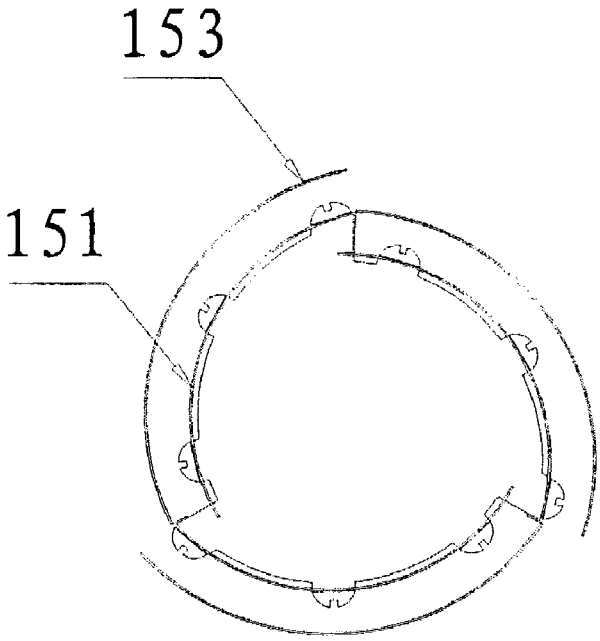
FIG. 5 is a perspective view of the structure of the centrifugal blades and the flicking slips.
Figure 6:
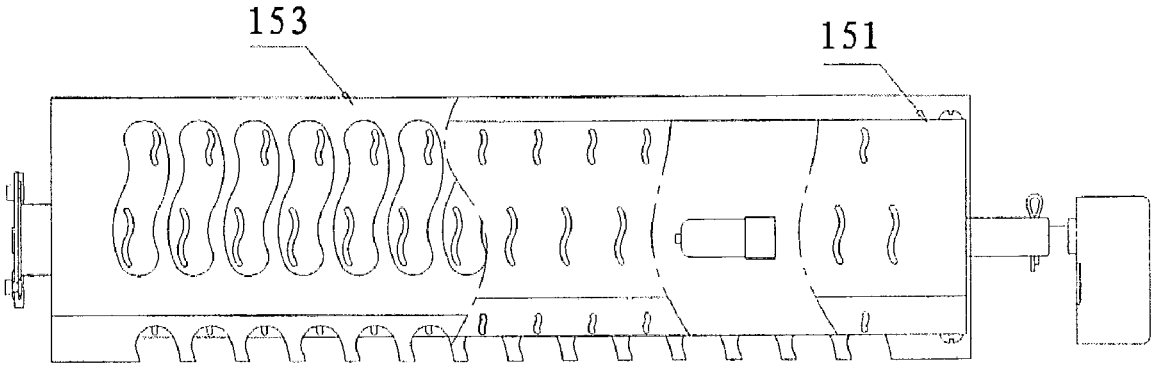
FIG. 6 is a perspective view of the figuration of the dynamic light source of the electric fireplace of the invention.

Referring to FIG. 5 and FIG. 6, three colorful flicking boards 153 are set at the periphery of the centrifugal blades 151. The curvatures of the flicking board 153 are in the similar arc shape with the centrifugal blade 151. The flicking board may be colorful such as red translucent material. One end of the flicking board 153 is connected with one end of the centrifugal blade 151. Thus the light passing through the centrifugal blades 151 may be flicked onto the flicking board 153.

Figure 7:
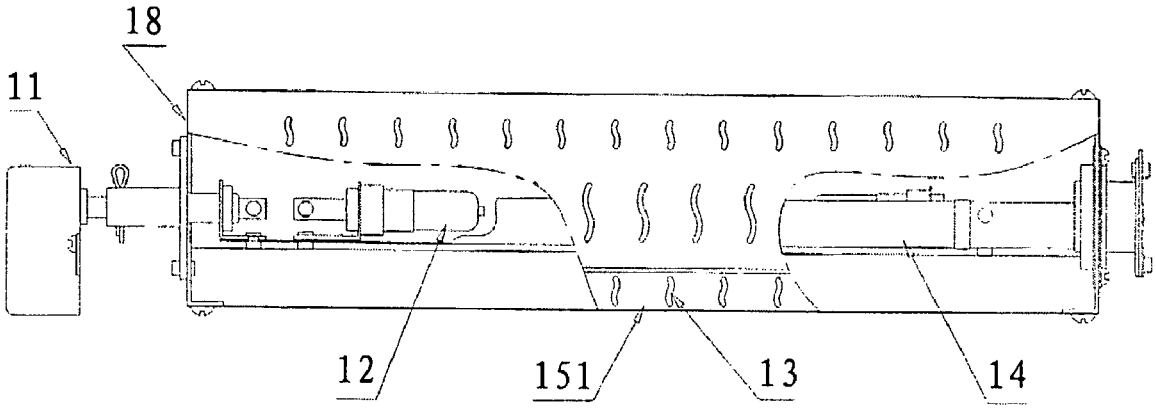
FIG. 7 is a perspective view of the structure of the dynamic light source of the electric fireplace of the invention.
Figure 8:
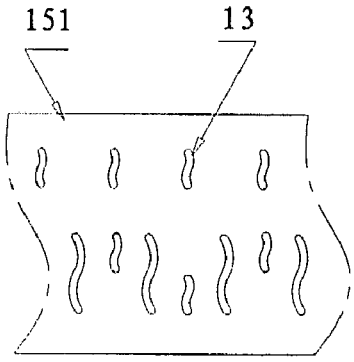
FIG. 8 is a perspective view of the photic aperture on the centrifugal blades of the invention.

Referring to FIG. 7, the two ends of the centrifugal blade 151 are connected with the two ends of the sideboard 18. One of the sideboards 18 is fixed with the axis of the electric motor 11. The fixed light source 12 is set on the connecting rod 14 for locating the light source. The connecting rod and the axis of the electric motor 11 are in the same line. There are many photic apertures 13 in flame shape on the centrifugal blades 151. Referring to FIG. 8, the photic aperture may be in S shape, triangle or any other shapes.

Figure 9:
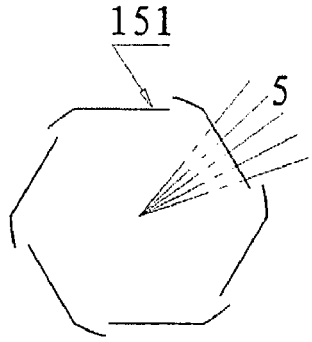
FIG. 9 is a perspective view of the distribution of the six centrifugal blades in another preferred embodiment of the invention.

Referring to FIG. 9, it is a perspective view of the distribution of the centrifugal blades in another preferred embodiment of the invention that includes six blades. The blades are in flake shape. Others are in the same with the first embodiment.

The working process of the invention is shown as follow: press the switch of the light source and the fixed light source 12 illuminates. At the same time, the centrifugal blades 151 rotate with the electric motor 11. Light from the fixed light source 12 sending out through the multiple groups of the flame apertures in the surface of the rotating centrifugal blades 151, forming the dynamic punctate light source 5. Light from the flicking light source sends out through the clearance strap 22 of the rotating blades and forms dynamic flake light source 21. Light from the two dynamic light sources is filtered by the diffusing screen and sends out to the glass wall 7 with the mirror surface. Thus one can see the leaping and rising flame. The simulated charcoal 3 in branches shape is installed under and before the flame, light source 8 is installed in the simulated charcoal 3. After powered, the simulated branches charcoal will be in combustion state with rubicund veins. The light intensity of the simulated flame may be adjusted by control the switch of the light source. An electric heater 10, which selected from all types of electric heating assembly, locates under the fireplace. It will heat by turning on a switch of temperature controlling. There are also electric heater 10 located under the electric fireplace, which selected from all types of electric heater. By turning on the temperature selection switch it will give out heat.

For a person skilled in the field, any kinds of changes or alternative without any creative improvement will be obvious by the spirit of the invention. For example:

1. The shapes of centrifugal blades 151 may be any other curvilinear besides arc surface, square surface. The number of centrifugal blades 151 may be varied and determined by the size, shape and locating mode.

2. The fixed means of centrifugal blades 151 and axis of electric motor 11 may be varied. The main requirement is to make centrifugal blades 151 rotating around the axis near that of the centre line of fixed light source 12. For example, centrifugal blades may be linked with axis of electric motor 11 by connection rod.

3. The color of the flicking board 153 may be selected according to the requirement of simulating flame. In addition, the flicking boards may be in the same color or in different color.

4. The number of the flicking board 153 may be varied and determined by the size, shape and locating mode.

5. The flicking board 153 may also locate between the fixed light source 1 and the centrifugal blades 151.

6. The flicking board 153 may also be omitted.

7. The photic apertures 41 on the surface of the diffusing screen 4 may also be omitted.

Therefore, the protection scope of the invention is determined as claimed.

I claim:

1. A fireplace comprising: a fire simulating assembly, wherein the fire simulating assembly comprises a semitransparent light filter screen; a mirror glass wall; and a dynamic light source, wherein in which the said dynamic light source comprises a fixed light source and a photic cover comprising a plurality of rotating centrifugal blades; wherein each centrifugal blade of the plurality of centrifugal blades rotates about a same central axis; and wherein a center of curvature of each centrifugal blade of the plurality of centrifugal blades is not in line of a center axis of the fixed light source; a plurality of in which there are many colorful flicking boards located at a periphery of the plurality of centrifugal blades, wherein in which one side of each flicking board of the plurality of flicking boards is connected with one side of the said plurality of centrifugal blades, the other sides of said plurality off centrifugal blades and said plurality of flicking boards board are connected with two covering boards, the two covering boards are connected with an axis of an electric motor.

2. The fireplace with fire simulating assembly according to claim 1, wherein in which the said plurality of centrifugal blades comprise a plurality of having many photic apertures having a in flame shape.

3. The fireplace with fire simulating assembly according to claim 1, wherein: in which the distributing mode of the said centrifugal blades is:

said plurality of centrifugal blades are located at a periphery of the fixed light source;

wherein said plurality of centrifugal blades are never joined together with each other and form a glistening clearance; and wherein light from the light source is reflected through said plurality of centrifugal blades.

4. The fireplace according to claim 1, wherein said plurality of centrifugal blades are arc shaped.

5. The fireplace according to claim 1, wherein said plurality of centrifugal blades are planar shaped.

6. The fireplace according to claim 1, wherein the fireplace comprises at least three centrifugal blades.

7. The fireplace according to claim 1, wherein the fireplace comprises at least six centrifugal blades.

8. The fireplace according to claim 1, wherein two ends of said plurality of centrifugal blades are connected with one covering board, the covering board is connected with an axis of an electric motor.

9. The fireplace according to claim 1, further comprise a plurality of photic apertures in flame shape.

10. The fireplace according to claim 1, wherein said lighting source is fixed in a central line of the axis of said electric motor.

* * * * *